US008176966B2

(12) United States Patent
Yoshida et al.

(10) Patent No.: US 8,176,966 B2
(45) Date of Patent: May 15, 2012

(54) PROCESS AND EQUIPMENT FOR PRODUCING COPPER ALLOY MATERIAL

(75) Inventors: Hirokazu Yoshida, Tokyo (JP); Tsukasa Takazawa, Tokyo (JP); Toshio Abe, Tokyo (JP); Shuji Tomimatsu, Tokyo (JP)

(73) Assignee: The Furukawa Electric Co., Ltd., Tokyo (JP)

( * ) Notice: Subject to any disclaimer, the term of this patent is extended or adjusted under 35 U.S.C. 154(b) by 0 days.

(21) Appl. No.: 12/745,522

(22) PCT Filed: Nov. 28, 2008

(86) PCT No.: PCT/JP2008/071725

§ 371 (c)(1), (2), (4) Date: May 28, 2010

(87) PCT Pub. No.: WO2009/069781

PCT Pub. Date: Jun. 4, 2009

(65) Prior Publication Data

US 2010/0307712 A1 Dec. 9, 2010

(30) Foreign Application Priority Data

Nov. 30, 2007 (JP) ..... 2007-311616
Nov. 27, 2008 (JP) ..... 2008-302814

(51) Int. Cl.
*B22D 27/00* (2006.01)

(52) U.S. Cl. ..... 164/55.1; 164/4.1; 164/453

(58) Field of Classification Search ..... 164/453, 164/55.1, 4.1

See application file for complete search history.

(56) References Cited

U.S. PATENT DOCUMENTS 5,062,614 A * 11/1991 Sukekawa et al. ..... 266/216
5,846,346 A * 12/1998 Lee et al. ..... 148/433

FOREIGN PATENT DOCUMENTS

| | | | |
|---|---|---|---|
| EP | 0 259 772 | A2 | 3/1988 |
| JP | 55-128353 | A | 10/1980 |
| JP | 58-65554 | A | 4/1983 |
| JP | 59-169654 | A | 9/1984 |
| JP | 59-171834 | A | 9/1984 |
| JP | 63-62830 | A | 3/1988 |
| JP | 8-300119 | A | 11/1996 |
| JP | 2002-86251 | A | 3/2002 |
| JP | 2006-341268 | A | 12/2006 |

* cited by examiner

*Primary Examiner* — Jessica L Ward
*Assistant Examiner* — Nicholas D'Aniello
(74) *Attorney, Agent, or Firm* — Birch, Stewart, Kolasch & Birch, LLP

(57) ABSTRACT

A process for producing a copper alloy material from a copper alloy of a precipitation reinforced type, which contains a process to perform individually a dissolution of a pure copper and a dissolution of an additional element or a mother alloy containing the same, comprises the steps of: melting an element and/or a mother alloy at a same time, that is selected from a Ni, a Co, an Si, a Ni—Cu mother alloy, a Co—Cu mother alloy, an Si—Cu mother alloy, a Ni—Si—Cu mother alloy, and a Co—Si—Cu mother alloy with combining therebetween, and melting thereof with an assistance of a generation of a heat of mixing, in a case of forming a high density melt containing at least either one of the Ni or the Co, and the Si, as high density thereof; forming the high density melt as a content of the Ni to be 80 mass % at maximum; and forming an alloy molten metal having a predetermined component and concentration, by adding the melt into a pure copper molten metal to be supplied from another melting furnace.

12 Claims, 5 Drawing Sheets

PROCESS AND EQUIPMENT FOR PRODUCING COPPER ALLOY MATERIAL

TECHNICAL FIELD

The present invention relates to a process and an equipment for producing a copper alloy wire rod for such as a wire harness for vehicle, a cable for robot, a wire for other signal usage, or the like, or a copper alloy sheet material or a copper alloy plate material for electrical and electronic component parts of such as a connector or the like (hereinafter, referred to as a copper alloy material as named generically).

BACKGROUND ART

Regarding producing the copper alloy material for the copper alloy wire rod or for the copper alloy sheet material, at first, there is known the following process as the most common process (A) for a melting technology. First, a copper raw material, a scrap, and an additional element or a master alloy solid matter containing thereof are thrown into a melting furnace (an electric furnace, a gas furnace), and then a dissolution is performed therefor. Next, after melting all the substances in the furnace inside, a sample for analysis is collected from the inside of the furnace, a component and a concentration are measured and confirmed by using a chemical analysis or an instrumental analysis, and then a quality governing therefor is performed. Next, a slab, a billet, or the like, is cast by using a water cooled casting after confirming the predetermined component and the concentration, and then the wire rod or the sheet material becomes to be manufactured by performing re-heating such an ingot which is cooled once to a room temperature, and by performing a hot rolling and an extrusion therefor.

And regarding the above mentioned melting process, generally an induction heating process is adopted, and it is well known that an energy efficiency thereof is not good.

Next, there is known a series casting by using a belt and wheel type for such as an SCR or the like as another technology (refer to a patent document 1 for example), and it is the method as a lower processing cost thereby comparing to that according to the billet casting. Here, in such the process, a casting is performed for obtaining a predetermined alloy composition by throwing an additional element into between a melting furnace and a casting machine. It is desirable to perform a series dissolution casting for reducing a processing cost, however, a duration for series casting becomes shorter in a case where a dissolution capacity is inferior to a casting capacity. And then a processing cost rather becomes higher due to becoming a fraction defective thereof to be higher, because a proportion of the defective becomes to be relatively larger at a time of starting and stopping therefor. Hence, it becomes required an installation of a larger melting furnace for corresponding to the casting capacity thereof, and then an initial investment in plant and equipment becomes to be a huge amount thereof. Thus, it is desirable to develop a melting equipment having an equivalent capacity to the casting capacity with less investment in plant and equipment. On the contrary, according to the technology disclosed in the patent document 1, the energy efficiency is high due to making use of a shaft kiln exclusively as the melting furnace. However, according to such the process, only a dilute copper alloy may be dissolved thereby (it is able to provide as an example a Cu-0.7% Sn alloy as the highest concentration or the like).

Therefore, there is known a process (B), wherein an additional element or a master alloy solid matter containing thereof is directly thrown into a flowing molten copper and then a component is prepared by the series dissolution of the additional element, or a molten metal storage part is provided at a part where the molten metal passes therethrough, which comprises a heating part, and then an alloying element is added and mixed thereinto. Moreover, there is known a process (C) (refer to a patent document 2, 3 and 4 for example), wherein a molten metal is added directly at a transferring process of a molten metal at a period of a series casting therefor and then a preparation of a component is performed therefor. According to such the process: a heater is arranged directly onto a tundish of a series casting therefor, which drives out the alloying element as to be a semi-molten state or a molten state, the alloying element is dripped into a molten metal in the tundish inside and stirred, and then a homogeneous molten metal is obtained (the patent document 2); a molten copper is accommodated in a tundish inside and a Ni and a P are added as a form of a Ni—P compound into such the molten copper in the tundish inside (the patent document 3); a wire rod comprised of an additive alloy component is continuously melted or semi-molten by using an arc discharge, or the above mentioned additive alloy component to be melted or to be semi-molten is added into a molten metal of a basic metal component to be fluidized, and then a molten metal is obtained in which the above mentioned additive alloy component is melted (the patent document 4).

Further, as a process for performing a component preparation at a period of series casting, there is known a process (D) (refer to a patent document 5 for example), wherein an electric conductivity of a rough drawing wire to be processed by using a series casting and rolling is measured continuously, and then a dosage of the alloying element is continuously controlled by performing a feed back of such the result therefor.

However, there is only an alloy of simple solid solution hardening type which is put to practical use. And, it is impossible to perform a component assay according to the electric conductivity of the rough drawing wire, because the electric conductivity thereof is varied with depending on a precipitation state at a period of a hot rolling therefor regarding an alloy of precipitation type, such as a Cu—Ni—Si base or the like.

Still further, there is already known regarding the measurement of the resistance of a molten metal by energizing with electricity therethrough. For example, each of the specific resistance values of the pure metals are shown in "Metal Data Book" edited by Japan Society of Mechanical Engineers, and the values are larger than the specific resistance values at a room temperature therefor respectively (refer to Table 1). However, regarding the copper alloy, the Corson alloy in particular, the resistance of the molten state therefor has not known yet. It may be considered that it becomes possible to control thereof somehow if it becomes cleared regarding a relationship between a component of such the alloyed and the specific resistance at the molten state thereof, however, it has not realized yet.

TABLE 1

Comparison of specific resistances

| ELEMENT | SOLID TEMPERATURE (° C.) | SOLID SPECIFIC RESISTANCE | MELT TEMPERATURE (° C.) | MELT SPECIFIC RESISTANCE | MELTING POINT (° C.) |
|---|---|---|---|---|---|
| Cu | 20 | 1.67 | 1100 | 20.2 | 1083 |
| Ni | 20 | 6.84 | 1454 | 85.0 | 1453 |
| Si | 20 | $2.3 \times 10^{10}$ | 1410 | 82.0 | — |

Unit of specific resistance: μΩcm

Furthermore, as a process to be paid attention to an electrical characteristic of such the molten metal and to be made use of an assay of the properties regarding the molten metal, there is known a process (E) for detecting an inclusion in the molten metal (in the aluminum alloy in particular) (refer to a patent document 6 for example). According to such the process, an amount of a reduction due to the inclusion regarding a cross section of an electric current path is monitored, wherein the electric current in the electric current path inside is assumed to be as between one and 500 A, an electrical resistance thereof in the path inside is measured continuously, and then a variation of an electric signal is measured at a period when the inclusion particle passes through the electric current path inside. However, it is not for detecting a variation of a resistance value according to a variation in concentration of the molten metal in the electric current path inside.

[Patent Document 1] Japanese Patent Application Publication No. Shou 55-128353 (1980-128353)

[Patent Document 2] Japanese Patent Application Publication No. Shou 59-169654 (1984-169654)

[Patent Document 3] Japanese Patent Application Publication No. Hei 8-300119 (1996-300119)

[Patent Document 4] Japanese Patent Application Publication No. 2002-086251

[Patent Document 5] Japanese Patent Application Publication No. Shou 58-065554 (1983-065554)

[Patent Document 6] Japanese Patent Application Publication No. Shou 59-171834 (1984-171834)

DISCLOSURE OF THE INVENTION

According to such the process (A), regarding a general furnace (coreless furnace) to melt such as a refuse, in a case where a Ni, and a Si or a Si—Cu mother alloy as to be raw materials therefor are dissolved therein, the Ni having a higher melting point is thrown thereinto at an initial stage thereof, and then the Si or the Si—Cu mother alloy is thrown thereinto at a later stage of the dissolution, which is active corresponding to an oxygen. Moreover, the dissolution progresses with absorbing a heat of such the thrown row materials with the specific heat and the specific latent heat thereof, and then it is required a lot of the thermal energy therefor. Further, it becomes required a large scale melting equipment as a matter of course.

Still further, according to such the process (B), in a case of adding and melting an element having a high affinity corresponding to the oxygen, such as a light element of the Si, and the Ni having a larger specific gravity into the molten copper, it becomes sometimes required to perform a preprocessing to be able to neglect a surface oxidization for a Si particle to be easily dissolved therein for example. Still further, the following phenomena of such as the term numbers of 1 to 3 occur. And then there are happened to occur some inconveniences that it is not dissolved, an addition yield becomes worse, the Si or the Si mother alloy becomes accumulated around an addition location in a case of adding thereof for a long period of time and then it becomes obstructing a new addition therefor, it becomes unable to make use of a heat of mixing thereof, or the like.

1. The Si cannot help but float on a surface of the molten copper, meanwhile, the Ni cannot help but sink deeply from the surface of the molten copper, due to a difference of the specific gravity therebetween;

2. The Si is reacted with a very small amount of an oxygen in an atmosphere at an upper region from the top surface of the molten copper, and then an oxide layer becomes to be formed on a surface of an additive material (it becomes to be an oxidative gas for the Si under a high temperature thereof even in a sealing environment with using a CO gas);

3. It reacts with the very small amount of the oxygen (as not less than 10 ppm) remaining in the molten copper, it forms an oxide layer at an interface contacted to the molten copper, and then the dissolution becomes stagnated.

According to the process (C), there is known a method of a solid and a melt addition for a series processing of a high density alloy therefor. However, it has a disadvantage that a dosage thereof is not stabilized due to such as an adhesion of a slag or the like according to such the addition, that it becomes easier for a component variation to occur, and then that it becomes hard to obtain an alloy molten metal to be prepared thereby.

Moreover, as described above, according to the process (D), it is impossible to perform the assay of the components by using the electrical conductivity thereof for the ally of the precipitation type, such as the Cu—Ni—Si base or the like. And then it is not able to obtain the alloy molten metal to be prepared thereby. Further, according to the process (E), it is not designed for detecting a variation in electrical resistivity thereof according to a variation in concentration of the molten metal, and then it is impossible to obtain an alloy molten metal to be prepared thereby as similar thereto.

According to performing a series casting and rolling of the above mentioned copper alloy of the precipitation reinforced type, a stabilization of a losing amount of heat is tried by blowing repeatedly a soot generated under an incomplete combustion of an acetylene gas at an inner surface of a slide facing cast. However, in a case of processing an alloy containing the Si, such as the Cu—Ni—Si based alloy or the like, the Si as the main component and the soot are reacted therebetween, and then an SiC cannot help but be formed. Hence, it is not able to form a layer of the soot having a high insulation effectiveness to be stabilized at the inner surface of the cast thereof. And then it just becomes able to obtain only an ingot having a temperature of approximately 150° C. as quite lower even in a case of adopting the conditions of the casting and the cooling as similar to that for a tough pitch copper. As a result, the precipitation is progressed at the period of the series rolling therefor, it becomes unable to obtain a rough drawing wire of a solution heated state, and then it becomes unable to process a wire rod having a predetermined property even in a case of performing an aging treatment therefor. Moreover, for suppressing the precipitation at the period of the series rolling therefor, an induction furnace is performed for the ingot immediately after the casting thereof, however, a huge quantity of electricity becomes to be required due to a small cross section of the ingot.

Further, in a case of series casting the above mentioned copper alloy of the precipitation reinforced type by using a slide facing cast of a belt and wheel type or a dual belt type, a burr is generated slightly at a contacting part between the belt and a copper block, and then removing the burr is tried by using a cutting blade to be generally used (made from a stellite as a material therefor). However, such the copper alloy is adhered to (burnt onto) a tip of the blade of such the cutting blade, and then it becomes unable to perform the cutting any longer. Hence, the hot rolling is still performed as continuing therefor, however, tucking defects happen frequently on a surface of the wire. Thus, it is extremely important to solve regarding such the subjects.

Here, the subjects of the present invention are: to provide a melting furnace having a melting capability as similar to the capability of the series casting with a less investment in plant and equipment therefor; to form a melt of high density by melting an additive alloy component of high density with using a less thermal energy therefor; to prevent from forming an oxide layer for the Si; to obtain an alloy molten metal having a predetermined component and concentration by controlling an addition amount of the high density melt; and to provide a process and an equipment for producing a copper alloy material of the precipitation reinforced type with a higher speed therefor and with a lower producing cost therefor.

The present inventors have investigated deeply with having regard to the above mentioned subjects, obtained the following knowledge, and then developed into the present invention by basing thereon.

It is well known that a heat of mixing is generated according to an enhancement of the entropy in a case of mixing a dissimilar element melt. However, such the phenomenon is not used for a molten relationship of the copper alloys. By making use of such the heat positively, it becomes able to achieve a formation of a high density melt with energy saving therefor.

Moreover, in a case of joining the high density melt into a pure copper molten metal, a remained oxygen in the molten copper is reacted with such as the Si or the like, and then an oxide layer is formed thereon. However, the oxide layer formed on a surface of the melt is easily broken away by giving a stir power thereto, and then it becomes possible to perform stably a blend thereof. Further, for designing a stabilization of an alloy composition, according to an adjustment of an amount to be spouted thereof by simply using a control of tilting or a control of pressure, which is adopted generally, a component of the alloy molten metal is varied in a variety thereof, due to such as an adhesion of a slag or the like to a sprue runner, and then a reliability thereof becomes less. Therefore, here it is to be designed to adopt a combination of two of feed back controls and such the above mentioned controls with using together.

Here, according to the present invention, it becomes able to provide the following processes and the like.

1. A process for producing a copper alloy material from a copper alloy of a precipitation reinforced type, which individually contains a process to perform a dissolution of a pure copper and a process to perform a dissolution of an alloy for melting an additional element or a mother alloy containing the same, and a process to perform a series casting and rolling by using a slide facing cast of a belt and wheel type or of a dual belt type, or a process to cast a slab or a billet by using a vertical series casting, which is characterized in that the process for producing the copper alloy material comprises the steps of: throwing an element and/or a mother alloy, that is selected from a Ni, a Co, an Si, a Ni—Cu mother alloy, a Co—Cu mother alloy, an Si—Cu mother alloy, a Ni—Si—Cu mother alloy, a Co—Si—Cu mother alloy, a Ni—Si mother alloy, a Co—Si mother alloy, and a Ni—Co—Si mother alloy, with combining therebetween, into a high density melting furnace at a same time, and melting therein under a generation of a heat of mixing, in a case of forming a high density melt containing at least either one of the Ni or the Co, and the Si, as high density thereof, at the process to perform the dissolution of the alloy; forming the high density melt as a content of the Ni, the Co, or a total of the Ni and the Co to be 80 mass % at maximum, as a content of the Si to be as between 0.2 and 0.4 times as the content of the Ni, the Co, or the total of the Ni and the Co; and forming an alloy molten metal having a predetermined component and concentration, by adding the melt into a pure copper molten metal to be obtained from the process to perform the dissolution of the pure copper.

2. The process for producing the copper alloy material according to the process 1, wherein an amount of a molten metal is measured at a measuring gutter having a weir installed at a downstream side of the high density melting furnace, in a case of spouting the high density melt from the high density melting furnace of a tilting type, an amount to be spouted is controlled by performing a feedback regarding an amount of the molten metal passing therethrough to be calculated by using the amount of the molten metal in the measuring gutter to a predetermined relationship between a tilting angle of the furnace and the amount to be spouted, and a predetermined amount of the high density melt is added into the pure copper molten metal.

3. The process for producing the copper alloy material according to the process 1, wherein an amount of a molten metal is measured at a measuring gutter having a weir installed at a downstream side of the high density melting furnace, in a case of spouting the high density melt from the high density melting furnace of a pressure spouting type, an amount to be spouted is controlled by performing a feed back regarding an amount of the molten metal passing therethrough to be calculated by using the amount of the molten metal in the measuring gutter to a predetermined relationship between an injection volume of a pressurized gas and the amount to be spouted, and a predetermined amount of the high density melt is added into the pure copper molten metal.

4. The process for producing the copper alloy material according to the process 2 or 3, wherein a gas bubbling is performed at a merging section that the high density melt to be spouted therefrom is added into the pure copper molten metal (V: kg/min), a gross stir power is added as not less than 30 $W/m^3$ thereby, and a gross mass of accumulated melt is set as not less than 9 V (kg) that is from the merging section to a casting spout.

5. The process for producing the copper alloy material according to the process 2 or 3, wherein a mechanical agitation or a rotary degassing agitation is performed at a merging section that the high density melt to be spouted therefrom is added into the pure copper molten metal (V: kg/min), a gross stir power is added as not less than 20 $W/m^3$ thereby, and a gross mass of accumulated melt is set as not less than 9 V(kg) that is from the merging section to a casting spout.

6. The process for producing the copper alloy material according to any one of the processes 1 to 5, wherein the copper alloy of the precipitation reinforced type contains the Ni as between 1.0 and 5.0 mass %, the Si as between 0.25 and 1.5 mass %, and a left percentage comprised of the Cu and an unavoidable impurity element, or contains the Ni as between 1.0 and 5.0 mass %, the Si as between 0.25 and 1.5 mass %, at least one of elements as between 0.01 and 1.0 mass % selected from a group comprised of an Ag, a Mg, a Mn, a Zn, an Sn, a P, a Fe, an In, a misch metal and a Cr, and a left percentage comprised of the Cu and an unavoidable impurity element.

7. The process for producing the copper alloy material according to any one of the processes 1 to 5, wherein the copper alloy of the precipitation reinforced type contains the Ni and the Co as between 1.0 and 5.0 mass % in total, the Si as between 0.25 and 1.5 mass %, and a left percentage comprised of the Cu and an unavoidable impurity element, or contains the Ni and the Co as between 1.0 and 5.0 mass % in total, the Si as between 0.25 and 1.5 mass %, at least one of elements as between 0.01 and 1.0 mass % selected from a group comprised of the Ag, the Mg, the Mn, the Zn, the Sn, the P, the Fe, the In, the misch metal and the Cr, and a left percentage comprised of the Cu and an unavoidable impurity element.

8. The process for producing the copper alloy material according to any one of the processes 1 to 7, wherein an inner surface of the slide facing cast is coated by using a boron nitride in a case of casting a copper alloy.

9. The process for producing the copper alloy material according to any one of the processes 1 to 7, wherein a corner part of an ingot to be casted by using the slide facing cast is cut by using a cutting blade, that a main component thereof is a titanium nitride (TiN), and that a thermal spraying is performed therefor.

Moreover, according to the present invention, it becomes able to provide the following equipments and the like.

10. An equipment for producing a copper alloy material from a copper alloy of a precipitation reinforced type, by which a process is performed individually for a dissolution of a pure copper and for a dissolution of an additional element or a mother alloy containing the same, and a process is performed for a series casting and rolling by using a slide facing cast of a belt and wheel type or of a dual belt type, or a process is performed to cast a slab or a billet by using a vertical series casting, which is characterized in that the equipment for producing a copper alloy material comprises: a pure copper melting furnace; a high density melting furnace to form a high density melt as a content of a Ni, a Co, or a total of the Ni and the Co to be 80 mass % at maximum, as a content of an Si to be as between 0.2 and 0.4 times as the content of the total of the Ni and the Co, with using at least either one of the Ni or the Co, and the Si or a mother alloy containing the same; and a mixing vessel to add and mix the high density melt into a pure copper molten metal, wherein an element and/or a mother alloy is thrown, that is selected from the Ni, the Co, the Si, a Ni—Cu mother alloy, a Co—Cu mother alloy, an Si—Cu mother alloy, a Ni—Si—Cu mother alloy, a Co—Si—Cu mother alloy, a Ni—Si mother alloy, a Co—Si mother alloy, and a Ni—Co—Si mother alloy, with combining therebetween, into the high density melting furnace at a same time, and the high density melt is formed by melting therein under a generation of a heat of mixing, and an alloy molten metal having a predetermined component and concentration is formed by adding and mixing the high density melt into the pure copper molten metal to be supplied from the pure copper melting furnace.

11. The equipment for producing the copper alloy material according to the equipment 10, wherein the high density melting furnace is a tilting type, a measuring gutter having a weir, and a measuring apparatus for an amount of a molten metal attached to the gutter are installed at a downstream side of the high density melting furnace, a control mechanism is installed for performing a feed back regarding an amount of the molten metal passing therethrough to be calculated by using the amount of the molten metal in the measuring gutter to a predetermined relationship between a tilting angle of the furnace and the amount to be spouted, the amount of the high density melt to be spouted from the high density melting furnace is controlled thereby, and a predetermined amount of the high density melt is added and mixed into the pure copper molten metal.

12. The equipment for producing the copper alloy material according to the equipment 10, wherein the high density melting furnace is a pressure spouting type, a measuring gutter having a weir, and a measuring apparatus for an amount of a molten metal attached to the gutter are installed at a downstream side of the high density melting furnace, a control mechanism is installed for performing a feed back regarding an amount of the molten metal passing therethrough to be calculated by using the amount of the molten metal in the measuring gutter to a predetermined relationship between an injection volume of a gas and the amount to be spouted, the amount of the high density melt to be spouted from the high density melting furnace is controlled thereby, and a predetermined amount of the high density melt is added and mixed into the pure copper molten metal.

13. The equipment for producing the copper alloy material according to the equipment 11 or 12, wherein a bubble agitator is installed at the mixing vessel to add and mix the high density melt to be spouted therefrom into the pure copper molten metal (V: kg/min), a gross stir power due to a gas bubbling is added as not less than 30 $W/m^3$ thereby, and a gross mass of accumulated melt is set as not less than 9 V(kg) that is from the mixing vessel to a casting spout.

14. The equipment for producing the copper alloy material according to the equipment 11 or 12, wherein a mechanical agitating apparatus or a rotary degassing apparatus is installed at the mixing vessel to add the high density melt to be spouted therefrom into the pure copper molten metal (V: kg/min), a gross stir power is added as not less than 20 $W/m^3$ thereby, and a gross mass of accumulated melt is set as not less than 9 V(kg) that is from the mixing vessel to a casting spout.

15. The equipment for producing the copper alloy material according to any one of the equipments 10 to 14, wherein the copper alloy of the precipitation reinforced type contains the Ni as between 1.0 and 5.0 mass %, the Si as between 0.25 and 1.5 mass %, and a left percentage comprised of the Cu and an unavoidable impurity element, or contains the Ni as between 1.0 and 5.0 mass %, the Si as between 0.25 and 1.5 mass %, at least one of elements as between 0.1 and 1.0 mass % selected from a group comprised of an Ag, a Mg, a Mn, a Zn, an Sn, a P, a Fe, an In, a misch metal and a Cr, and a left percentage comprised of the Cu and an unavoidable impurity element.

16. The equipment for producing the copper alloy material according to any one of the equipments 10 to 14, wherein the copper alloy of the precipitation reinforced type contains the Ni and the Co as between 1.0 and 5.0 mass % in total, the Si as between 0.25 and 1.5 mass %, and a left percentage comprised of the Cu and an unavoidable impurity element, or contains the Ni and the Co as between 1.0 and 5.0 mass % in total, the Si as between 0.25 and 1.5 mass %, at least one of elements as between 0.01 and 1.0 mass % selected from a group comprised of the Ag, the Mg, the Mn, the Zn, the Sn, the P, the Fe, the In, the misch metal and the Cr, and a left percentage comprised of the Cu and an unavoidable impurity element.

The above and other aspects and advantages according to the present invention will be clarified by the following description, with properly reference to the accompanying drawings.

| | Description of the reference symbols |
|---|---|
| 1 | SHAFT KILN |
| 2 | HOLDING FURNACE |
| 3 | DEOXIDATION AND DEHYDROGENATION UNIT |
| 4 | MERGING SECTION (MIXING VESSEL) |
| 5 | FILTER |
| 6 | GUTTER |
| 7 | CASTING POT |
| 8 | CASTING SPOUT |
| 9 | SLIDE FACING CAST OF BELT AND WHEEL TYPE |
| 10 | HIGH DENSITY MELTING FURNACE OF TILTING TYPE |
| 11 | HIGH DENSITY MELTING FURNACE OF PRESSURE SPOUTING TYPE |
| 12 | MEASURING GUTTER |
| 13 | MEASURING APPARATUS |
| 13a | DETECTING ELEMENT |
| 14 | FIRE REFRACTORY MATERIAL (ALUMINA TUBE) |
| 15 | INGOT |
| 16 | BURR |

BEST MODE FOR CARRYING OUT THE INVENTION

A variety of examples regarding embodiments of a process and an equipment for producing a copper alloy wire rod according to the present invention will be described in detail below, based on the accompanying drawings. Here, a duplicated description will be omitted with using a similar symbol for the similar element regarding each of the drawings.

First, an assumption regarding an embodiment according to the present invention will be described in detail below. For an inner surface of a cast in a case of performing a series casting and rolling of a copper and a dilute copper alloy by using a slide facing cast of a belt and wheel type or a dual belt type, a soot generated under an incomplete combustion of an acetylene gas is blown repeatedly. Moreover, an ingot of a high temperature as not less than approximately 800° C. is cast, with performing a stabilization of a losing amount of heat and with preventing from seizing of the cast. And then a series rolling is performed therefor by using a hot rolling mill. Here, it is quite important to set a temperature of an ingot as high for maintaining a solution heated state even for the series casting and rolling of the above mentioned copper alloy of the precipitation reinforced type as well. If in a case where the temperature of the casting is lower, a temperature rising is tried to be performed before or on the way of the hot rolling mill by using an induction heating apparatus. Such the technique has already proposed by the present inventors and the like in such as Japanese Patent Application No. 2007-146226, or the like. An embodiment according to the present invention will be described in detail below.

Figure 1:
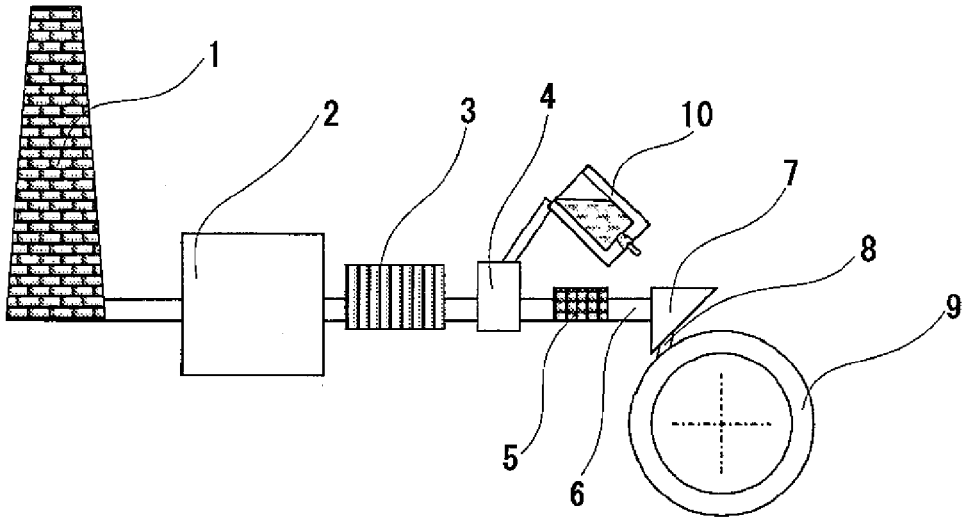
FIG. 1 is a schematic drawing showing one example of a process to perform a dissolution and a process to perform a series casting and rolling according to the present invention.
Figure 2:
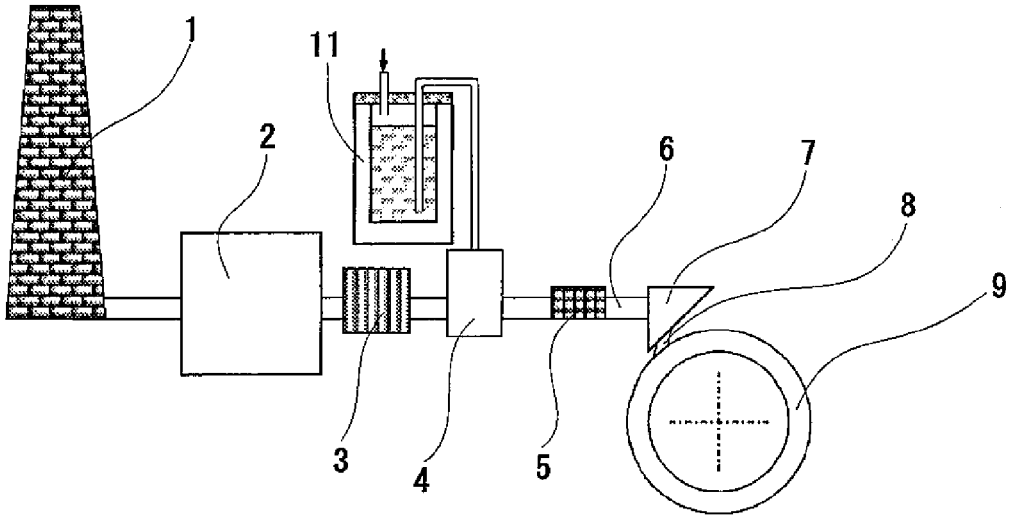
FIG. 2 is a schematic drawing showing another example of the process to perform the dissolution and the process to perform the series casting and rolling according to the present invention.

FIG. 1 and FIG. 2 show one example of an embodiment according to the present invention, and are schematic drawings showing one example of a series casting and rolling by using a slide facing cast of a belt and wheel type (there is not shown in the figure, such as a hot rolling mill, a tempering apparatus, or the like, to be followed thereby). As shown in FIG. 1 and FIG. 2, a raw copper is dissolved in a shaft kiln 1 at a temperature of between 1090° C. and 1150° C. Next, a pure copper molten metal is spouted from the shaft kiln 1 to a holding furnace 2. And then a molten copper in the holding furnace 2 is spouted to a merging section (mixing vessel) 4, for the melt with staying in the holding furnace 2 at a temperature of between 1100° C. and 1200° C. Moreover, it is desirable to install a deoxidation and dehydrogenation unit 3 at between the holding furnace 2 and the merging section 4.

Next, a high density melt containing an alloy element component is added into the pure copper molten metal at the merging section 4, which is spouted from a high density melting furnace of a tilting type 10 (FIG. 1) or from a high density melting furnace of a pressure type 11 (FIG. 2), and then it is adjusted to be a predetermined alloy composition. Here, it may be available to add individually a single element substance, such as selected at least one from a group comprised of an Ag, a Mg, a Mn, an Sn, a P, a Fe, an In, a misch metal (MM) and a Cr, or a mother alloy thereof, at a transferring process of the molten copper. However, it is further preferable to melt such the substances at a same time in the high density melting furnace. Moreover, it is able to process a predetermined amount of the alloy by using the high density melting furnace as one unit. However, it is further preferable to install the same as not less than two units. And then by spouting the alloy alternately therefrom, it becomes able to process a large amount of the alloy. Further, there is no problem at all for using a scrap as a raw material to be dissolved in such the high density melting furnace.

Still further, the alloy molten metal from the merging section 4 is transferred through a gutter 6 having a filter to be attached thereto, and then continuously to an inside of a casting pot 7. Still further, the alloy molten metal in such the casting pot 7 inside is poured from a casting spout 8 to a belt and wheel casting machine 9 as a rotary slide facing cast, with a state to be sealed by using an inert gas or a reducing gas, and then it becomes to be solidified. Still further, with maintaining a state so as not to decrease as possible a temperature of such the solidified ingot (as not lower than 900° C. to be desired, and there is no limitation for an upper limit in particular regarding the temperature of such the ingot, however, as not higher than 950° C. normally), it is performed a process of rolling to a predetermined wire diameter by using a series hot rolling mill (not shown in the figures), and then it is performed a process of hardening. Thus, it becomes able to process a copper alloy material of almost solution heat state. Still further, it becomes able to design such the copper alloy material as not only limited to a wire rod, but also as an arbitrary shape as well, such as a sheet material, a plate material, or the like.

Still further, above mentioned process of deoxidation is performed by using the heretofore known method, such as a method of contacting between a charcoal to be red heated and a molten metal. According to such the method, an oxygen in the molten metal is reacted with the charcoal of granular shape, becomes to be a carbonic acid gas, becomes floating up in the molten metal, and then becomes to be released. Still further, it is able to perform a process of dehydrogenation by using the heretofore known method, such as by contacting the molten metal to a non-oxidizing gas, an inert gas, or a reducing gas. Still further, it may be available to perform such the dehydrogenation after the process of deoxidation, or to perform at a same time with the process of deoxidation as well.

Still further, it becomes possible to perform a series casting for a long period of time therefor without breaking off, by providing a melting furnace having a dissolution capacity as similar to a casting capacity of a vertical series casting machine and that of a series casting machine having a slide facing cast of a belt and wheel type for such as the SCR or the like, or of a dual belt type, such as the Contirod or the like. For example, according to the SCR, there is provided the casting capacity of between 15 and 50 tons per hour entirely, and it is required an extraordinary large amount of investment in plant and equipment for having an electric melting furnace as equivalent thereto. Still further, a unit requirement for dissolution is not good either in a case of melting a whole thereof by using an electricity, and then there becomes happened a demerit, such as an increase in cost of processing, an increase in exhaust of $CO_2$, or the like. Therefore, by using a gas furnace (a reverberatory furnace or a shaft kiln) for melting a substance equivalent to a copper content except a substance for a scrap recycle, it becomes able to design an improvement on the unit requirement for dissolution thereof.

Furthermore, regarding an additional element therefor, by performing a dissolution thereof in the high density melting furnace (the 10 in FIG. 1, or the 11 in FIG. 2) as the electric furnace of exclusive use therefor, it becomes able to obtain a high density melt.

Here, according to the present invention, the high density for such as the high density melting furnace, the high density melt, or the like, means that a content of a Ni, a Co, or a total of the Ni and the Co is 80 mass % at maximum, meanwhile, a left percentage is occupied by an Si or the like, and a content of the Si is as between 0.2 and 0.4 times as the content of the Ni, of the Co, or of the total of the Ni and the Co. Moreover, regarding a lower limit therefor, there is no limitation in particular from an industrial point of view, however, it is desirable therefor to be as not less than five times as a component of an ingot from an economical point of view.

Further, in a case of producing the high density melt containing at least either one of the Ni or the Co, and the Si, an element and/or a mother alloy, that is selected from the Ni, the Co, the Si, a Ni—Cu mother alloy, a Co—Cu mother alloy, an Si—Cu mother alloy, a Ni—Si—Cu mother alloy, a Co—Si—Cu mother alloy, a Ni—Si mother alloy, a Co—Si mother alloy, and a Ni—Co—Si mother alloy, are added into the high density melting furnace at a same time with combining therebetween. Still further, the copper alloy of the precipitation reinforced type may contain at least one of elements selected from a group comprised of an Ag, a Mg, a Mn, a Zn, an Sn, a P, a Fe, an In, a misch metal (MM) and a Cr, and then it may be available to add such the element into such the melting furnace for the high density melt to contain thereof.

Still further, in a case of producing the high density melt in the high density melting furnace, a heat of mixing is generated rapidly if it is heated up to as not less than 1100° C. approximately, and then locally it becomes as quite high as not less than 1600° C. And then the dissolution is easily progressed because a surface oxide layer thereon is broken away due to a thermal expansion thereof by propagating such the heat to the Si or the like to be neighbored thereto. Thus, it becomes unnecessary to perform such as a reduction process for the Si or the like, and then it becomes able to use the Si of a lower price therefor. Still further, it becomes possible to melt with a remarkable energy saving, by using such the heat of mixing as chain like for a dissolution of the Ni, the Si, or the like, which is peripheral thereof.

Still further, it becomes able to perform a production of an alloy molten metal of the precipitation reinforced type, by melting completely the above mentioned element or the mother alloy, by performing a quality governing therefor, by spouting the high density melt thereafter, and then by blending with a pure copper molten metal.

Still further, regarding the content of the Ni, of the Co, or of the total of the Ni and the Co, as the component of such the high density melt, it is 80 mass % at maximum for the gross amount of the high density melt, and a left percentage is occupied by the Si or the like. However, it is desirable for the content of the Si to be as between 0.2 and 0.4 times as the content of the Ni, of the Co, or of the total of the Ni and the Co. Still further, it is preferable for the content of the Ni, of the Co, or of the total of the Ni and the Co, to be as not larger than 60 mass %, and the left percentage is occupied by the Si, the copper and another additional element, in a case of taking into consideration of a hot melt flow property. Furthermore, in a case at making use of such the melting furnace for designing a recycle of the scrap, it is desirable for the Ni to be as between 20 and 40 mass %, for the Si to be as between 5 and 11 mass %, and for a left percentage to be occupied by the copper and the other additional element.

Next, in a case of spouting such the high density melt form the high density melting furnace, for improving an accuracy to control an amount to be spouted thereof:

1. a measuring gutter is installed before the merging section (mixing vessel) at a downstream therefrom, in which a weir, such as a weir of triangle shape, a weir of square shape, or the like, is installed, the melt is designed to flow as getting over such the weir, and then an amount of the molten metal passing through the gutter inside is designed to be used therefor;

2. at the merging section where such the high density melt and the pure copper molten metal are merged thereinto, those are homogenized by giving an stir power with using a mechanical agitation or a babble agitation, and then a value of an electrical resistivity for an alloy molten metal, of which the high density melt and the pure copper molten metal are mixed homogeneously, is used as an alternative characteristic of a component and a concentration for a constituent element of the alloy molten metal.

And then by using such the two values thereof, it is designed to be as a feed back for controlling the amount to be spouted of the high density melt.

Figure 3:
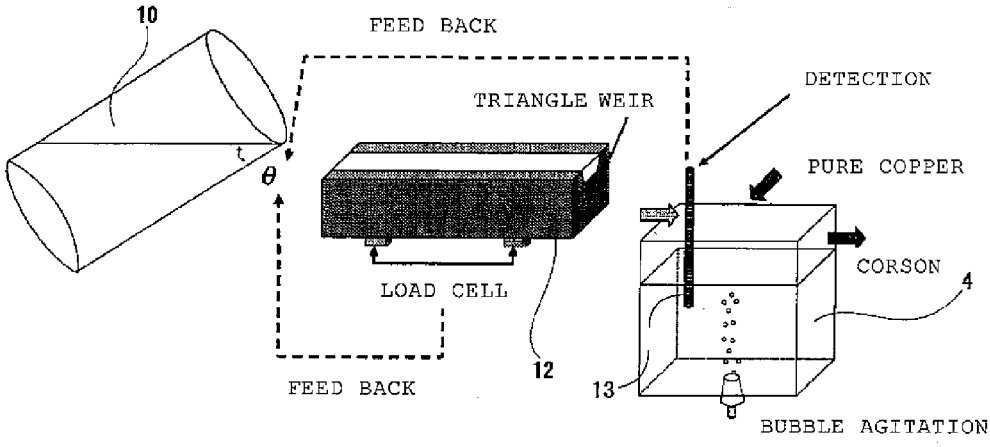
FIG. 3 is an explanatory drawing showing a process for controlling an amount to be spouted from a high density melting furnace of tilting type.
Figure 4:
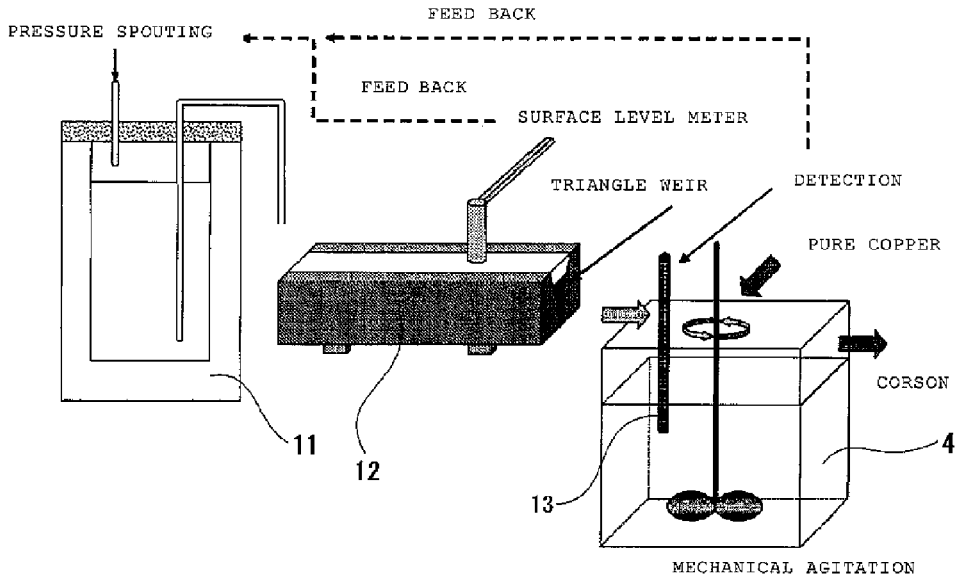
FIG. 4 is an explanatory drawing showing a process for controlling an amount to be spouted from a high density melting furnace of pressure spouting type.
Figure 5:
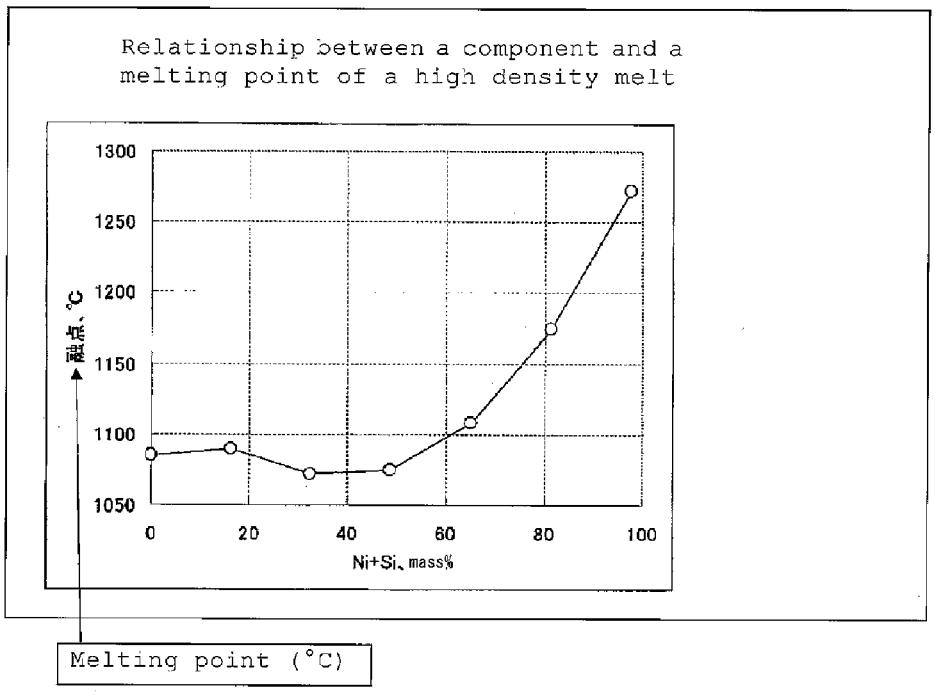
FIG. 5 is a graph showing a relationship between a component and a melting point of a high density melt.

Moreover, it may be available to evaluate the amount of the molten metal in a measuring gutter 12 after spouting therefrom. And, it is able to know based on a measurement value by using such as a load cell as shown in FIG. 3 or a liquid level meter as shown in FIG. 4. Further, an amount of the molten metal passing therethrough is calculated with using such the amount of the molten metal by using a method pursuant to such as the term No. 8 of the Japanese Industrial Standard (JIS) K0094 or the like. Still further, it is able to predetermine a relationship between a tilting angle of the high density melting furnace of the tilting type and the amount to be spouted therefrom according to the heretofore known operation achievement. Still further, it is able to predetermine a relationship between an injection volume of a pressurized gas into the high density melting furnace of the pressure spouting type and the amount to be spouted therefrom according to a test operation thereof.

Still further, regarding an electrical resistivity of the alloy molten metal, it is able to determine a compound and a concentration of the copper alloy with using a value of the electrical resistivity of the alloy molten metal by measuring an electrical resistivity with adding the high density melt, which is adjusted to be as a variety of component proportion beforehand, into the pure copper molten metal. The reason is that the relationship between such the component and the concentration thereof and the value of the electrical resistivity has a strong linearity, according to such the alloy molten metal due to containing at least one of the Ni or the Co, and the Si.

Still further, as shown in FIG. 3, the load cell to be attached to the measuring gutter 12 and a changing mechanism of a tilting angle in the high density melting furnace of the tilting type 10 are connected via a controlling mechanism therefor, the tilting angle (θ) is changed by using a value to be obtained at the load cell by performing a feed back control thereof, and then the amount to be spouted from the high density melting furnace is controlled. Or, as similar to the above description, as shown in FIG. 4, the liquid level meter to be attached to the measuring gutter 12 and a changing mechanism of the injection volume of the pressurized gas in the high density melting furnace of the pressure spouting type 11 are connected via a controlling mechanism therefor, the injection volume of the gas is changed by using a value to be obtained at the liquid level meter by performing a feed back control thereof, and then it becomes able to control the amount to be spouted from the high density melting furnace as well. Still further, there is no problem to store the high density melt at a ladle or the like either, which is spouted from the high density melting furnace, and then to perform a flow control therefor by using such as a needle valve, a sliding gate, or the like, though it is not so desirable due to increasing structures therefor.

Still further, as shown in FIGS. 3 and 4, a measuring apparatus 13 for detecting the electrical resistivity to be attached to the merging section (mixing vessel) and the changing mechanism of the tilting angle in the high density melting furnace of the tilting type 10 or the changing mechanism of the injection volume of the pressurized gas in the high density melting furnace of the pressure spouting type 11 are connected via a controlling mechanism therefor, the tilting angle (θ) or the injection volume of the gas is changed by using a value of the resistivity by performing a feed back control thereof, and then it becomes able to control the amount to be spouted from the high density melting furnace as well. Still further, it may be available to control the amount to be spouted from the high density melting furnace as well, in addition to the installation of the measuring apparatus 13 for detecting the electrical resistivity with attaching to the merging section (mixing vessel), by installing the same with attaching to the gutter 6 for the alloy molten metal to be flowed therethrough as shown in FIG. 6 and FIG. 7, and then by performing a feed back regarding a value of the resistivity therefor.

Furthermore, it is also able to control the amount to be spouted from the high density melting furnace by using together the feed back control based on the amount of the molten metal in the measuring gutter 12 and the feed back control based on the value of the electrical resistivity therefor.

Next, according to a controlling mechanism of the feed back, a weight passing therethrough is measured and multiplied by using a weight or a volume to be measured at the measuring gutter 12, in a cycle time of tilting regarding the high density melting furnace 10 of the tilting type. Moreover, an amount to be operated by using a tilting equipment of the furnace is changed for increasing or decreasing a tilting amount of the furnace at a next time thereof, in a case where such the weight is diverged from a predetermined weight thereof. Further, regarding an expression of relations for controlling the tilting of the furnace, here a relationship between a tilting angle of the furnace and an amount to be spouted therefrom regarding the high density melt in the furnace inside is evaluated by calculating mathematically therefor beforehand. Next, an electrical resistivity thereof is detected by using the measuring apparatus 13 in a period as not less than two times as the cycle time of tilting thereof, a component thereof is calculated thereby, and then it is averaged. Still further, an amount to be operated by using the tilting equipment of the furnace is changed for increasing or decreasing the tilting amount of the furnace at a next time thereof, in a case where such the value is diverged from a desired value therefor.

Figure 6:
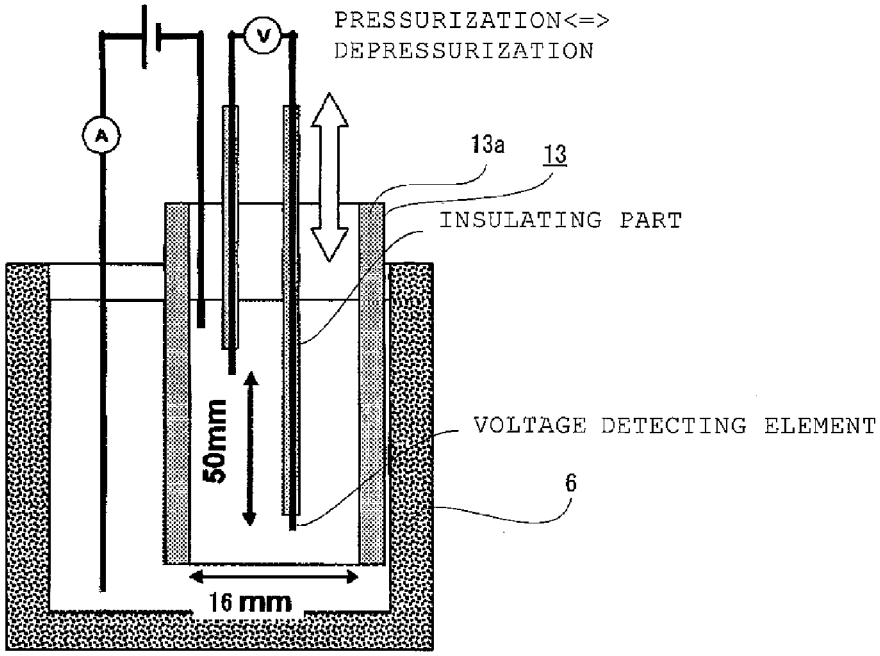
FIG. 6 is a schematic explanatory drawing showing one example of a measuring apparatus to be installed in a molten metal for detecting an electrical resistivity.
Figure 7:
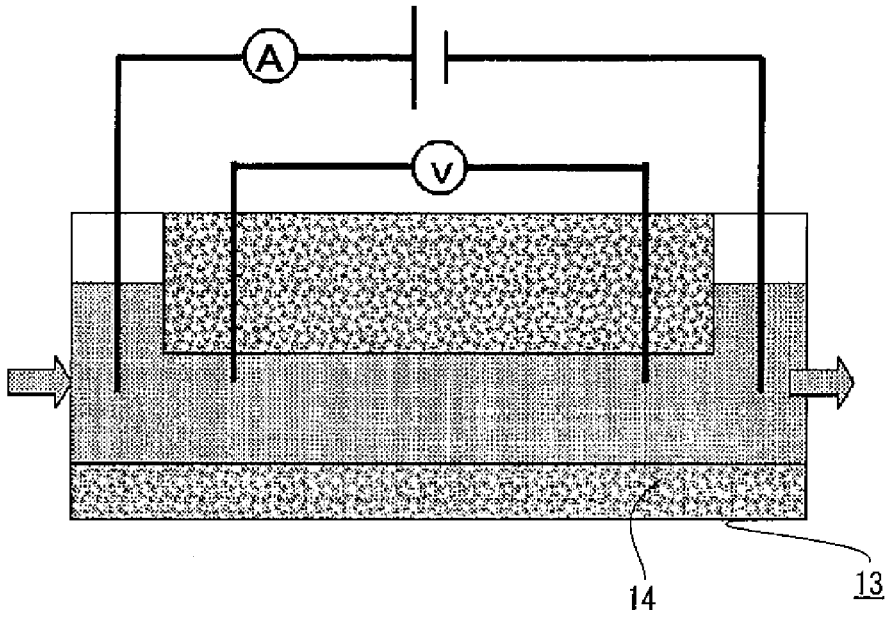
FIG. 7 is a schematic explanatory drawing showing another example of the measuring apparatus to be installed in the molten metal for detecting the electrical resistivity.

Next, one example of an embodiment regarding a measuring apparatus for detecting an electrical resistivity in a molten metal will be shown in FIG. 6 and FIG. 7. FIG. 6 is for the measuring apparatus 13 as having a cylindrical shape, wherein a detecting element 13*a* has a structure that one end part thereof is closed. While, FIG. 7 is for the measuring apparatus 13 that is formed by using a flowing path itself (a part of the gutter 6 for example) of the molten metal. Further, a 14 in FIG. 7 designates a structure in the measuring apparatus 13 and is a fire refractory material which is superior in nonconductivity, such as an alumina or the like. However, it is not necessarily to be a burned product (such as an alumina tube, a silica tube, or the like). Still further, it is desirable to measure such the electrical resistivity in the molten metal by using the four-terminal method with using a direct current or a pulsed current therefor, however, it may be available to measure the same with using an eddy current as well. Still further, the measuring apparatus 13 may be installed with attaching to the merging section 4, or may be installed with attaching to the gutter 6 for the alloy molten metal to be flowed therethrough. Still further, the copper alloy here has a higher temperature as different from an aluminum, and then it is desirable for a diameter of a cross section of the path for such the electric current to be as not smaller than 8 mm, in a case of taking into consideration of such as a terminal for applying a voltage thereto, a terminal for measuring the electric current thereof, and an insulating material therefor. Still further, it becomes possible to measure stably for a longer period of time, in a case where the diameter thereof is not smaller than 15 mm as it is further preferable. Still further, there is no limitation in particular regarding an upper limit for such the diameter of the cross section of the path therefor, however, it is not larger than 20 mm normally. Thus, it becomes clear that the alloy molten metal becomes to contain at least one of the Ni or the Co, and the Si, the relationship between such the component and the concentration thereof and the value of the electrical resistivity becomes to have a stronger linearity, and then it becomes able to feedback sufficiently from the value of the electrical resistivity, and to control the amount of the high density melt to be spouted therefrom. Furthermore, according to the measuring apparatus for detecting the electrical resistivity in FIG. 6, an application of pressure and a pressure reduction with using an inert gas, such as a nitrogen gas or the like, are performed for replacing alloy molten metals in the measuring apparatus inside.

Here, the objects to stir the merging section are:

1. for the value of the electrical resistivity to indicate the value for the whole of the molten metal, which is measured after mixing two types of the molten metals;

2. to break away the oxide layer, which is formed by the Si or the like having an affinity for the oxygen as stronger to be bonded with the oxygen in the pure copper molten metal.

In particular, for the above mentioned term 1, a gas babbling is performed. And, a gross stir power is required as not less than 30 $W/m^3$. Moreover, it is further preferable therefor to be as not less than 100 $W/m^3$, but approximately 400 $W/m^3$ at most therefor. Here, such the gross stir power (E: $W/m^3$) with using the gas babbling is calculated by using the following formula (1), which is reported by Mori, Sano, et al., "Iron and Steel", Vol. 67 (1981), pp. 672-695.

(Formula 1)

$$\epsilon=6.18\,V_g Tl/Vl[ln(1+h_0/1.46\,10^{-5}\,P_0)+\eta(1-T_0/Tl)] \quad (1).$$

Here, the Vg is a gas flow rate (Nm3/min), the Vl is a volume of a molten metal in a ladle (m3), the Tl is a temperature of a molten metal (K), the Tg is a temperature of a gas (K), the $h_0$ is a depth of gas blowing (m), the $P_0$ is a surface pressure of a molten metal (Pa), and the $\eta$ is a contributory coefficient assumed to be as 0.06.

Moreover, for the mechanical agitation, a gross stir power is required as not less than 20 $W/m^3$. And, it is further preferable therefor to be as not less than 100 $W/m^3$, but approximately 400 $W/m^3$ at most therefor. Here, the gross stir power is calculated by using the following formula (2).

(Formula 2)

$$\epsilon=T\omega/Vl \quad (2).$$

Here, the T is a rotating torque (W s), the $\omega$ is the number of revolutions (rad/s), and the Vl is the volume of the molten metal in the ladle ($m^3$).

Thus, the oxide layer of the surface of the high density melt to be generated at the period of the addition thereof into the pure copper molten metal is broken away, by giving such the stir power thereto. Moreover, it is desirable for the oxygen in the pure copper molten metal before adding the high density melt to be as not higher than 10 ppm by performing the process of the deoxidation. However, by giving the stir power thereto, it becomes possible to blend stably without performing the process of the deoxidation therefor beforehand if the concentration of the oxygen is not higher than 300 ppm. Therefore, it becomes able to construct a further smaller equipment therefor.

Moreover, it becomes able to form an alloy molten metal having a stable component and concentration even in a case where the addition of the high density melt is an intermittent spouting, by setting a gross mass of accumulated melt (kg), that is from such the merging section (mixing vessel) to the casting spout, as not less than nine times as the amount of the pure copper molten metal (V: kg/min) before mixing therewith. Further, it is further preferable to be as fifteen times as that thereof, and then a variation of the component becomes to be further smaller thereby. Furthermore, it is desirable to be as approximately twenty-five times as that thereof at most.

Next, a copper alloy of the precipitation reinforced type to be used for a process and an equipment for producing a copper alloy material according to the present invention will be described in detail below. Here, a Corson alloy (a copper alloy of the Cu—Ni—Si base) will be described below as a representative example, however, it is able to adopt any other alloyed as similar thereto if it is a copper alloy of the precipitation reinforced type.

An alloy to be obtained from the process and the equipment according to the present invention is comprised of an alloy of the precipitation reinforced type, such as the copper alloy of the Corson base or the like. For example, the copper alloy of the Corson base generally contains the Ni as between 1.0 and 5.0 mass %, the Si as between 0.25 and 1.5 mass %, and contains the Cu and an unavoidable impurity element as the left percentage thereof. Moreover, a copper alloy is also dealt with as similar thereto, wherein some amount of the Ni in the copper alloy of the Corson base or the whole amount thereof is substituted by a Co.

The reason to specify the Ni (or the total of the contents of the Ni and the Co) as between 1.0 and 5.0 mass % is for improving a strength thereof, and for obtaining a copper alloy material having a state or close to a state after performing a solution heat treatment (a state of solution heated) in a case where a hardening process is performed for an intermediate good of the copper alloy material in a halfway of a rolling process or immediately after the rolling process regarding the series casting and rolling process. In a case of the Ni (or the total of the contents of the Ni and the Co) to be as lower than 1.0 mass %, it is not able to obtain a sufficient strength thereof. Moreover, in a case where the value is larger than 5.0 mass %, it becomes difficult to obtain the state of solution heated or close to the state thereof even if the hardening process is performed in the halfway of the rolling process or immediately after the rolling process. Further, it is desirable for the Ni (or the total of the contents of the Ni and the Co) to be as between 1.5 and 4.5 mass %, and it is further preferable for the same to be as between 1.5 and 2.0 mass %.

Still further, the reason to specify the Si as between 0.25 and 1.5 mass % is for improving a strength thereof by forming a compound with the Ni and with the Co, and for obtaining a copper alloy material having a state of solution heated or close to a state thereof in a case where a hardening process is performed for an intermediate good of the copper alloy material in a halfway of the rolling process or immediately after the rolling process, as similar to the above mentioned Ni. In a case of the Si to be as lower than 0.25 mass %, it is not able to obtain a sufficient strength thereof. Still further, in a case where the value is larger than 1.5 mass %, it becomes difficult to obtain the state of solution heated or close to the state thereof even if the hardening process is performed in the halfway of the rolling process or immediately after the rolling process. Still further, it is desirable for the Si to be as between 0.35 and 1.25 mass %, and it is further preferable for the same to be as between 0.35 and 0.65 mass %.

Still further, the above mentioned copper alloy may contain at least one element selected from a group comprised of an Ag, a Mg, a Mn, a Zn, an Sn, a P, a Fe, an In, a misch metal (MM) and a Cr, as between 0.01 and 1.0 mass %. The reason is because the strength thereof becomes superior thereto in a case where such the metal elements are contained therein as between 0.01 and 1.0 mass %. In a case where the value is lower than 0.01 mass %, it is not able to obtain an effect sufficiently thereby. Still further, in a case where the value is larger than 1.0 mass %, it becomes difficult to obtain the state of solution heated or close to the state thereof even if the hardening process is performed for an intermediate good of the copper alloy material in the halfway of the rolling process or immediately after the rolling process. Still further, it is desirable for the content of such the elements to be as between 0.02 and 0.8 mass %, and it is further preferable for the same to be as between 0.05 and 0.2 mass %.

Figure 9:
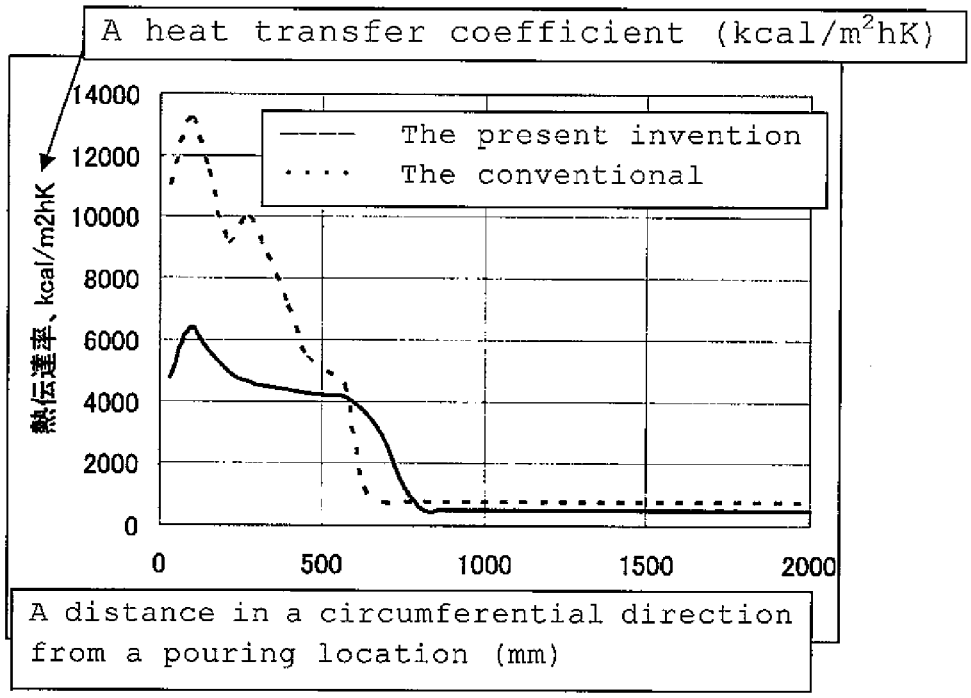
FIG. 9 is a graph showing a relationship of a heat transfer coefficient between an ingot and a casting ring.
Figure 10:
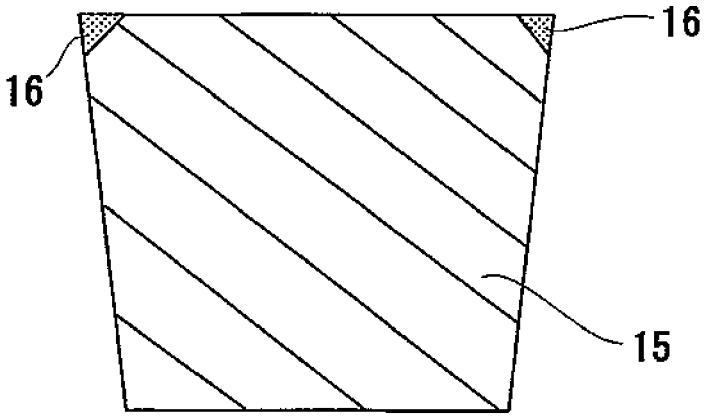
FIG. 10 is a sectional view showing a location for removing a genesis region of burr regarding an ingot.

Furthermore, on performing the series casting and rolling for the above mentioned copper alloy of the precipitation reinforced type, forming a sticking layer of a soot is tried by blowing repeatedly the soot generated under an incomplete combustion of an acetylene gas to an inner surface of a slide facing cast for turning out an ingot of a high temperature as similar to the conventional technology. However, the Si as the main component and the soot are reacted therebetween, and then such the layer cannot help but be formed. Therefore, according to the present embodiment, for being able to cast stably an ingot of a high temperature as not less than 800° C., an insulating layer is designed to be formed at the inner surface of the cast, which has a thickness of not less than 10 μm, or of not less than 50 μm as further preferably, without performing a process of an induction furnace, by coating or spraying a boron nitride (BN) on the inner surface of the slide facing cast. As a result, a coefficient of heat transfer at a contact surface between the ingot and a casting ring is reduced as shown in FIG. 9, and then it becomes able to turn out the ingot of the high temperature. Here, there is no limitation in particular regarding an upper limit of the thickness of such the insulating layer, however, it is not thicker than 60 μm normally.

Moreover, in a case of series casting the above mentioned copper alloy of the precipitation reinforced type by using the slide facing cast of the belt and wheel type or the dual belt type, a burr is generated slightly at a contacting part between the belt and a copper block. And then it is desirable to use a cutting blade on which a thermal spraying is performed with using a titanium nitride (TiN) as a main component having a thickness of not less than 2 μm, or of not less than 5 μm as further preferably, for preventing from adhering an adhered substance (a seizure) onto the cutting blade for cutting such the burr. Further, there is no limitation in particular regarding an upper limit for the thickness of such the thermal spraying, however, it is not thicker than 50 μm normally. Still further, by using such the cutting blade on which the thermal sprayed layer of TiN as the main component is formed, it becomes able to remove the burr stably with less adhering of the ingot.

Still further, according to the present invention, it becomes able to reduce an amount for investment in plant and equipment due to becoming smaller in size for the melting equipment even at a factory where the slide facing cast, such as the SCR, the Contirod, or the like, is existed therein. Still further, it becomes able to add the high density melt (containing the Ni, the Co, the Si, or the like) continuously or intermittently at the process of transferring the pure copper molten metal obtained at the melting furnace, and then it becomes able to turn out stably the alloy molten metal of the precipitation reinforced type having the preferred component and concentration, as a large amount thereof, with a lower producing cost therefor, and conveniently. Still further, it becomes able to turn out further stably the alloy molten metal by performing the feed back control for such the addition thereof.

Still further, it is not necessary for the raw material to be used therefor, such as the Si or the like, to be set up a heavy limitation thereto, but it is possible to make use of raw material with a lower price. And then it becomes able to perform the energy saving by making use of the heat of mixing, and to reduce the unit requirement for dissolution. Still further, it becomes able to design such as cleaning the furnace or the like regarding the process of transferring the molten metal as extremely less, and then it becomes easy for such as changing a product type or the like.

Still further, it becomes able to obtain a rough drawing wire having a state of the solution heated with using the ingot of the high temperature, by optimizing a condition of cooling at the period of casting therefor, without performing the induction furnace therefor. And then it becomes able to perform the energy saving, and to reduce the unit requirement for dissolution. Furthermore, it becomes able to produce stably the copper alloy material which is superior in surface quality thereof.

Thus, it becomes able to produce the copper alloy material of the precipitation reinforced type, within a shorter period of time for producing a large amount thereof, and with a lower producing cost therefor, and it becomes able to supply stably the same. As one example according to the result thereof, it becomes able to supply a wire harness with a lower producing cost therefor in a larger amount thereof comparing to the conventional product.

EXAMPLE

The present invention will be described in further detail below based on an example, however, the present invention is not limited thereto.

A series casting and rolling of a Corson alloy wire rod is performed at an SCR (series casting and rolling equipment). Moreover, a complete series casting is performed by spouting alternately a high density melt by using two of coreless furnaces of three tons for each thereof as the high density melting furnace. Here, a fire refractory material to be used for the coreless furnace is a common type to be used for melting a copper alloy.

Further, a Ni plate, an Si block and an Si—Cu of 20% are used for the raw materials, and then a high density melt (a melting point: 1110° C.) is formed to be as the Ni of 50 mass %, the Si of 13 mass %, and the left percentage of the copper. Still further, regarding the dissolution thereof, the Si—Cu of 20% is dissolved beforehand, and then the Ni plate and the Si block are thrown thereinto together. Hence, a light is generated as too bright to be blinded thereby due to the heat of mixing, and then the thrown raw materials are dissolved in no time. Thus, it becomes able to save the melting energy as approximately 14% less than the sum total of the energy in a case of melting the Cu, the Ni, the Si—Cu of 20%, the Si individually by following the general procedure of dissolution at the coreless furnace, by melting the raw materials in the shaft kiln with using the gas and in the high density melting furnace with using the electricity.

Next, a button sample is collected after the dissolution in such the high density melting furnace, a fluorescent X-ray analysis is performed for such the sample, and then an adjustment is performed therefor to be a target concentration. Here, a lot of intermetallic compound of $Ni_XSi_Y$ are contained in such the sample to be collected here, and then it is impossible for such the high density substance to be a wire by drawing. Hence, it is determined that it is not able to adopt the technology disclosed in the Japanese Patent Application Publication No. 2002-086251 (the patent document 4).

Next, the spouting of the high density melt is performed from such the coreless furnace by controlling the tilting thereof. Moreover, the relationship between the tilting angle and the amount to be spouted therefrom is predetermined beforehand according to the inner shape of the furnace. And then the spouting is performed as 8.7 kg/time (equal to the rate of the casting times the target component divided by the component in the high density melt divided by the frequency for the unit time), with the interval of thirty seconds per cycle (between starting spouting and stopping thereof). However, it becomes to be a amount to be spouted different from the predetermined amount to be spouted, due to adhesion of the slag onto the inner wall of the furnace. Therefore, the triangle weir is installed at the measuring gutter to be installed on the load cell at the downstream side thereof, and then the mass measurement is performed therefor. Moreover, the total mass of the gutter at the right time of overflowing through such the weir is assumed to be zero, and then the trial calculation is performed regarding the passing mass of the molten metal for every cycle, according to the amount to be increased therefrom.

According to the output result therefrom, it is found that there is a tendency for the amount to be spouted to decrease at the later stage of the spouting in particular. And then the compensation for the short amount thereof is performed, by performing the feed back of the short amount thereof to the tilting duration of the cycle at the next time. Thus, it becomes able to obtain the stable component according to such the control of the feed back.

However, there are observed the case sometimes that the slag is adhered at the triangle weir part of the above mentioned gutter, and then that the component of the alloy in the ingot becomes to be decreased thereby (the frequency (equal to the irregularity occurred lot divided by the whole casted lot) of 6%). For correcting such the irregularity, a melt accumulating part of 300 kg is installed at the mixing vessel (merging section 4) for the high density melt and the pure copper molten metal, and then the stir power of 108 W/m$^3$ is given by blowing the nitrogen gas of ten litters per minute from a porous plug at a hearth of such the melt accumulating part. Moreover, four of the electrodes are installed at the melt accumulating part of such the merging section 4 for measuring by using the four-terminal method. And then a prevention from occurring the irregularity is performed, by early detecting the irregularity which occurs very rarely, with using the result of such the resistivity measurement therefor, and then by performing the control of feed back therefor.

According to the present example, the detecting element 13*a* of the measuring apparatus 13 for which an alumina tube having an inner diameter ϕ of 16 mm is dipped from an upper part of the melt accumulating part of the merging section 4, and then a replacement of the molten metal in the detecting element 13*a* inside is performed, by repeating an application of pressure and an exhaust (returning to the atmospheric pressure), using the nitrogen gas introducing into the tube inside, with an interval of five seconds. Moreover, there is no problem at all to use another fire refractory material to be superior in insulating property (a silica tube for example) for such the alumina tube. Further, in a case where the diameter ϕ is 5 mm as the maximum therefor, according to the technology disclosed in such as the Japanese Patent Application Publication No. S59-171834 (the patent document 6) or the like, a suction becomes to be required, and then a configuration and a maintenance of the measuring instruments and apparatus become to be complicated. However, according to such the measuring apparatus 13, only the application of pressure is required, and then it becomes able to deal therewith conveniently.

Moreover, because of the combination thereof, it becomes able to produce stably (twenty tons per hour) for the rough drawing wire (ϕ of 8 mm) of Corson alloy containing the Ni as 2.6 mass %, the Si as 0.65 mass %.

Figure 8:
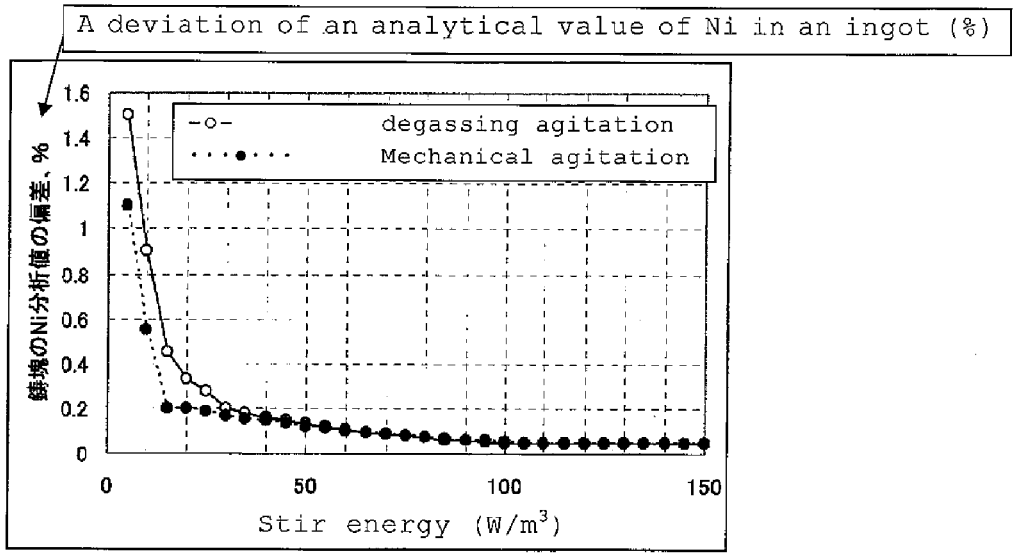
FIG. 8 is a graph showing a relationship between a stir power and a deviation of an analytical value of Ni in a molten metal.

Further, a sample for analysis is collected from the molten metal at the downstream of the merging section for such the high density melt and the pure copper molten metal, as setting to be an on for the control of the amount to be spouted according to the passing mass of the molten metal through the measuring gutter, and as setting to be an off for the feed back according to the electrical resistivity thereof, with changing a stir power by using the gas bubbling, and then an analysis is performed therefor. Still further, the result therefrom is shown in FIG. 8. And then it becomes able to obtain the result as sufficiently stable under such the condition according to the present example, meanwhile, it becomes insufficient as the deviation of the analytical value of the Ni (the maximum concentration minus the minimum concentration) becomes larger under the condition of the stir power to be as less than 30 W/m$^3$.

Still further, the cooling equipment for the process of hot rolling became broken down at the period of continuous operation for such the wire rod, and then the cooling water became sprayed with the amount as not less than the predetermined amount therefor. Hence, the temperature of quench hardening became decreased, and then the rough drawing wire became obtained with progressing the precipitation therefor. Still further, the electric conductivity of such the part became to be the value of 35% as the value largely diverged from the value of 22% for the normal part. Thus, it becomes determined that it is not able to control therefor by using the technology of control which is disclosed in the Japanese Patent Application Publication No. 1983-065554 (the patent document 5).

Still further, three of the spray nozzles are installed for facing to the inner surface of the casting ring, the other spray nozzle as one is installed for facing to the casting belt, and then forming the stable layer is performed by spraying the boron nitride therefrom. Hence, it becomes able to obtain the ingot of 835° C. according to coating the boron nitride, meanwhile, the ingot of 690° C. is turned out according to the soot to be turned out under the incomplete combustion of the acetylene. Still further, the stable layer in such the case thereof becomes to have the thickness of 75 μm.

Still further, it may be available to install a burr removal apparatus as not shown in the figures for removing the burr on the ingot 15, at such as between the slide facing cast 9, which is shown in FIG. 1 and in FIG. 2, and the rolling mill to be followed thereto as not shown in the figures. Still further, the blade is used for the cutting blade of such the burr removal apparatus, on which the thermal spraying is performed with using the titanium nitride as the main component having the thickness of 15 μm. And then the burr 16 at the corner part of the ingot 15 is removed by performing the cutting. Thus, there becomes no adhered substance appeared on the cutting blade even after performing the casting continuously for the five hours. And then it becomes able to remove the burr stably during such the period.

Industrial Applicability

It becomes able to produce a copper alloy material of a precipitation reinforced type, such as a wire harness for vehicle, a cable for robot, a wire for other signal usage, or the like, or a copper alloy of a precipitation reinforced type for electrical and electronic component parts of such as a connector or the like, within a shorter period of time for producing a large amount thereof, and with a lower producing cost therefor, and it becomes able to supply stably the same.

Thus, the present invention is described with the embodiments therefor, however, the present invention will not be limited to every detail of the description as far as a particular designation, and it should be interpreted widely without departing from the spirit and scope of the present invention as disclosed in the attached claims.

The present invention claims the priority based on Japanese Patent Application No. 2007-311616 patent applied in Japan on the thirtieth of November, 2007, and on Japanese Patent Application No. 2008-302814 patent applied in Japan on the twenty-seventh of November, 2008, the entire contents of which are expressly incorporated herein by reference.

What is claimed is:

1. A process for producing a copper alloy material from a copper alloy of a precipitation hardening type, comprising the steps of:

placing at least one element source to include at least either one of Ni or Co, and Si selected from the group consisting of Ni, Co, Si, a Ni—Cu mother alloy, a Co—Cu mother alloy, an Si—Cu mother alloy, a Ni—Si—Cu mother alloy, a Co—Si—Cu mother alloy, a Ni—Si mother alloy, a Co—Si mother alloy, a Ni—Co—Si mother alloy, and combinations thereof into a high density melting furnace of a tilting type or of a pressure pouring type, melting said at least one element source in the high density melting furnace, under a heat of mixing the same, thereby forming a high density melt containing said at least either one of Ni or Co, and Si, at a high density;

wherein the high density melt has a content of Ni, Co, or a total of Ni and Co of 80 mass % or lower and has a content of Si of between 0.2 and 0.4 times the content of Ni, Co, or the total of Ni and Co;

placing pure copper into another melting furnace to provide a molten pure copper therein;

pouring the high density melt from the high density melting furnace into the molten pure copper in said another melting furnace to form the copper alloy of a precipitation hardening type which is molten and has a given composition at given concentrations of elements; and subjecting the thus-formed molten copper alloy to continuous casting-and-rolling with a movable casting mold of a belt-and-wheel type or of a twin-belt type or casting into a slab or billet thereof with a vertical continuous casting apparatus to solidify the copper alloy material, wherein an amount of the molten copper alloy is monitored at a measuring spout having a weir provided at a downstream side of the high density melting furnace to control an amount of the high density melt to be poured into the molten pure copper based on:

(A) a feed back of an amount of the molten copper alloy passing through the measuring spout calculated from an amount of the molten copper alloy in the measuring spout with respect to a predetermined relationship between a tilting angle of the high density melting furnace of a tilting type and the amount to be poured such that a predetermined amount of the high density melt would be continuously added into the molten pure copper, or (B) a feed back of an amount of the molten copper alloy passing through the measuring spout calculated from an amount of the molten copper alloy in the measuring spout with respect to a predetermined relationship between an injection volume of a pressurized gas to the high density melting furnace of a pressure pouring type and the amount to be poured such that a predetermined amount of the high density melt would be continuously added into the molten pure copper.

2. The process for producing the copper alloy material according to claim 1, wherein a gas bubbling is performed at a merging section where the high density melt is added into the molten pure copper (V: kg/min), to provide a gross stirring power in an amount of not less than 30 $W/m^3$, and wherein a gross mass of accumulated molten copper alloy is set to an amount of not less than 9×V (kg) from the merging section to a casting spout, or wherein a mechanical agitation or a rotary degassing agitation is performed at a merging section where the high density melt is added into the molten pure copper (V: kg/min), to provide a gross stirring power in an amount of not less than 20 $W/m^3$, and wherein a gross mass of accumulated molten copper alloy is set to an amount of not less than 9×V (kg) from the merging section to a casting spout.

3. The process for producing the copper alloy material according to claim 1, wherein the copper alloy of the precipitation hardening type contains Ni with a content between 1.0 and 5.0 mass %, and Si with a content between 0.25 and 1.5 mass % with the balance being Cu and an unavoidable impurity element, or contains Ni with a content between 1.0 and 5.0 mass %, Si with a content between 0.25 and 1.5 mass %, and at least one element with a content between 0.01 and 1.0 mass % selected from the group consisting of Ag, Mg, Mn, Zn, Sn, P, Fe, In, a misch metal, and Cr, with the balance being Cu and an unavoidable impurity element, or contains Ni and Co with a content between 1.0 and 5.0 mass % in total, and Si with a content between 0.25 and 1.5 mass %, with the balance being Cu and an unavoidable impurity element, or contains Ni and Co with a content between 1.0 and 5.0 mass % in total, Si with a content between 0.25 and 1.5 mass %, and at least one element with a content between 0.01 and 1.0 mass % selected from the group consisting of Ag, Mg, Mn, Zn, Sn, P, Fe, In, a misch metal, and Cr, with the balance being Cu and an unavoidable impurity element.

4. The process for producing the copper alloy material according to claim 2, wherein the copper alloy of the precipitation hardening type contains Ni with a content between 1.0 and 5.0 mass %, and Si with a content between 0.25 and 1.5 mass %, with the balance being Cu and an unavoidable impurity element, or contains Ni with a content between 1.0 and 5.0 mass %, Si with a content between 0.25 and 1.5 mass %, and at least one element with a content between 0.01 and 1.0 mass % selected from the group consisting of Ag, Mg, Mn, Zn, Sn, P, Fe, In, a misch metal and Cr, with the balance being Cu and an unavoidable impurity element, or contains Ni and Co with a content between 1.0 and 5.0 mass % in total, and Si with a content between 0.25 and 1.5 mass %, with the balance being Cu and an unavoidable impurity element, or contains Ni and Co with a content between 1.0 and 5.0 mass % in total, Si with a content between 0.25 and 1.5 mass %, and at least one element with a content between 0.01 and 1.0 mass % selected from the group consisting of Ag, Mg, Mn, Zn, Sn, P, Fe, In, a misch metal, and Cr, with the balance being Cu and an unavoidable impurity element.

5. The process for producing the copper alloy material according to claim 1, wherein, in the step of subjecting the molten copper alloy to continuous casting-and-rolling with a movable casting mold of a belt-and-wheel type or of a twin-belt type, an inner surface of the movable casting mold is coated with boron nitride.

6. The process for producing the copper alloy material according to claim 2, wherein, in the step of subjecting the molten copper alloy to continuous casting-and-rolling with a movable casting mold of a belt-and-wheel type or of a twin-belt type, an inner surface of the movable casting mold is coated with boron nitride.

7. The process for producing the copper alloy material according to claim 3, wherein, in the step of subjecting the molten copper alloy to continuous casting-and-rolling with a movable casting mold of a belt-and-wheel type or of a twin-belt type, an inner surface of the movable casting mold is coated with boron nitride.

8. The process for producing the copper alloy material according to claim 4, wherein, in the step of subjecting the molten copper alloy to continuous casting-and-rolling with a movable casting mold of a belt-and-wheel type or of a twin-belt type, an inner surface of the movable casting mold is coated with boron nitride.

9. The process for producing the copper alloy material according to claim 1, further comprising the step of:

after the step of subjecting the molten copper alloy to continuous casting-and-rolling with a movable casting mold of a belt-and-wheel type or of a twin-belt type, cutting a corner portion of the thus-formed ingot of the copper alloy material with a cutting blade, with the cutting blade being subjected to thermal spraying in which a main component in the thermal spraying is titanium nitride.

10. The process for producing the copper alloy material according to claim 2, further comprising the step of:

after the step of subjecting the molten copper alloy to continuous casting-and-rolling with a movable casting mold of a belt-and-wheel type or of a twin-belt type, cutting a corner portion of the thus-formed ingot of the copper alloy material with a cutting blade, with the cutting blade being subjected to thermal spraying in which a main component in the thermal spraying is titanium nitride.

11. The process for producing the copper alloy material according to claim 3, further comprising the step of:

after the step of subjecting the molten copper alloy to continuous casting-and-rolling with a movable casting mold of a belt-and-wheel type or of a twin-belt type, cutting a corner portion of the thus-formed ingot of the copper alloy material with a cutting blade, with the cutting blade being subjected to thermal spraying in which a main component in the thermal spraying is titanium nitride.

12. The process for producing the copper alloy material according to claim 4, further comprising the step of:

after the step of subjecting the molten copper alloy to continuous casting-and-rolling with a movable casting mold of a belt-and-wheel type or of a twin-belt type, cutting a corner portion of the thus-formed ingot of the copper alloy material with a cutting blade, with the cutting blade being subjected to thermal spraying in which a main component in the thermal spraying is titanium nitride.

* * * * *